US008960409B2

(12) United States Patent
Widmaier

(10) Patent No.: US 8,960,409 B2
(45) Date of Patent: Feb. 24, 2015

(54) TRANSPORT UNIT AND METHOD OF OPERATING SAME

(75) Inventor: Dominik Widmaier, Berlin (DE)

(73) Assignee: Wincor Nixdorf International GmbH (DE)

( * ) Notice: Subject to any disclaimer, the term of this patent is extended or adjusted under 35 U.S.C. 154(b) by 129 days.

(21) Appl. No.: 13/401,466

(22) Filed: Feb. 21, 2012

(65) Prior Publication Data

US 2013/0105272 A1 May 2, 2013

(51) Int. Cl.
*A47F 9/04* (2006.01)
*G07G 1/00* (2006.01)

(52) U.S. Cl.
CPC ..... *G07G 1/0045* (2013.01); *A47F 9/048* (2013.01)
USPC ..... 198/340; 235/470

(58) Field of Classification Search
CPC ..... A47F 9/04; G07G 1/0045
USPC ..... 198/340; 235/470
See application file for complete search history.

(56) References Cited

U.S. PATENT DOCUMENTS

| | | | | |
|---|---|---|---|---|
| 3,708,655 | A | 1/1973 | Schanne | |
| 5,252,814 | A | 10/1993 | Tooley | |
| 5,543,607 | A | 8/1996 | Watanabe | |
| 5,609,223 | A * | 3/1997 | Iizaka et al. | 186/61 |
| 5,679,941 | A * | 10/1997 | Iizaka et al. | 235/383 |
| 5,920,056 | A * | 7/1999 | Bonnet | 235/383 |
| 6,142,376 | A | 11/2000 | Cherry et al. | |
| D536,192 | S | 2/2007 | Kruse et al. | |
| 7,387,241 | B2 | 6/2008 | Hassenbuerger | |
| 7,407,056 | B2 | 8/2008 | Lutz | |
| 8,074,785 | B2 | 12/2011 | Twiste | |
| 8,430,311 | B2 * | 4/2013 | Ostrowski et al. | 235/383 |
| 2006/0266824 | A1 | 11/2006 | Hassenbuerger | |
| 2006/0283943 | A1 | 12/2006 | Ostrowski et al. | |
| 2008/0110724 | A1 | 5/2008 | Twiste | |
| 2009/0039164 | A1 | 2/2009 | Herwig et al. | |
| 2010/0072220 | A1 | 3/2010 | Michels | |
| 2010/0258381 | A1 | 10/2010 | Baitz et al. | |
| 2012/0018520 | A1 | 1/2012 | Twiste | |
| 2012/0187194 | A1 * | 7/2012 | Svetal et al. | 235/470 |

FOREIGN PATENT DOCUMENTS

| | | |
|---|---|---|
| DE | 2 264 518 | 5/1972 |
| DE | 101 41 429 | 8/2001 |
| DE | 20206878 | 4/2002 |
| DE | 10235865 | 8/2002 |
| DE | 202005007089 | 5/2005 |
| DE | 20 2004 021 433 | 3/2008 |
| DE | 10 2008 049 160 | 9/2008 |
| DE | 202008012862 | 9/2008 |
| DE | 102008044795 | 3/2010 |
| WO | 03-007256 | 1/2003 |

OTHER PUBLICATIONS

Extended European Search Report for Application No. 11 00 9451 mailed on May 7, 2012 (6 pages).

* cited by examiner

*Primary Examiner* — Ramya Burgess
*Assistant Examiner* — Thomas Randazzo
(74) *Attorney, Agent, or Firm* — Harness, Dickey & Pierce, P.L.C.

(57) ABSTRACT

The invention relates to a transport unit for conveying items to a scanning unit or a self-service cash register system with a belt conveyor for transporting the items in a transport direction and with a marking unit assigned to the belt conveyor for identifying placement areas open for the placement of items on an item placement surface of the belt conveyor, where a detection unit is assigned to the belt conveyor for detecting a rear edge of the items, and a control unit cooperates in such a manner with the marking unit and the detection unit, and a restricted area not open for the placement of items is formed between a front placement surface, and a rear placement surface where the front face of said area, is defined by the rear edge of the item assigned to the front placement area.

19 Claims, 2 Drawing Sheets

TRANSPORT UNIT AND METHOD OF OPERATING SAME

CROSS REFERENCE TO RELATED APPLICATIONS

This application claims the benefit and priority of German Patent Application No. 10 2011 000087.9 filed Nov. 1, 2011. The entire disclosure of the above application is incorporated herein by reference.

BACKGROUND OF THE INVENTION

1. Field of the Invention

The invention relates to a transport unit for conveying items to a scanning unit of a self-service cash register system, with a belt conveyor to transport the item in a transport direction and with a marking unit to identify placement areas on an item placement surface of the belt conveyor open for placing items.

2. Discussion

The invention further relates to a method for dividing an item placement surface of a belt conveyor of a transport device for transporting items into a plurality of placement areas open for placing items, arranged one behind the other in a transport direction of the transport unit, where the individual placement areas are identified by means of a marking unit.

Self-service cash register systems are in increasing use in retail to identify the items selected by a customer largely automatically and to calculate the bill for the purchase. To do this, the items are usually optically recorded contactlessly with the help of a scanning unit as one surface of the items is scanned and a marking specifically serving to identify the item is recorded.

In order to ensure reliable scanning of the entire surface of the item, a device known as a tunnel scanner is used as a scanning unit, for example. The items are conveyed automatically to the tunnel scanner, typically over a transport unit having a belt conveyor. The tunnel scanner has a plurality of scanning modules that are attached to a frame arranged in the shape of an archway over the belt conveyor. With the help of the scanning modules, the entire surface of the item is scanned, with the exception of a contact side on which the items are lying on an item placement surface of the belt conveyor. The items deposited manually by the customer on the item placement area are typically not oriented in any particular way. A further scanning module can be arranged below the belt conveyor for optical scanning of the items in such manner that the contact surface of the items can also be optically detected through a recess in the transport unit.

In order to ensure a high degree of automation and a low error rate, the items to be recorded are conveyed sequentially to the scanning unit. For this purpose, for example, it is known from DE 102 35 865 A1 to assign marking units to the belt conveyor by means of which the item placement surface formed by the slack side of the belt conveyor can be divided into a plurality of placement areas of a specified size. The customer is requested to deposit only one item in each placement area on the belt conveyor. This method ensures that the items can be conveyed to the scanning unit spaced apart and be identified reliably. The limits of the individual deposit areas are highlighted visually, for example, by means of the marking unit. The disadvantage is that the placement areas are of a constant, pre-defined size, which is also determined by the design. The placement areas cannot be adapted to the size of the item assigned to them. The fault lies with the rigid assignment of the marking unit to the belt conveyor. In this respect, the spacing of the individual items is unnecessarily large, particularly with a small-sized item, and limits the flow of items. In contrast, very large items in particular can project beyond the limits of the placement areas.

SUMMARY OF THE INVENTION

An object of the present invention is, therefore, to cite a transport unit and a method to operate the transport unit in such a way that the flow of items at a self-service cash register system using the transport unit is increased and reliable, automatic detection of items of any size is enabled.

To achieve the object, the preferred embodiment of the invention is characterized in that a detector unit is assigned to the belt conveyor to detect a rear edge of an item, as viewed in the transport direction, and in that a control unit cooperates with the marking unit and the detector unit in such a manner that a restricted area is created, which is not open for the placement of items, between a front placement area, as viewed in the transport direction and a rear placement area, as viewed in the transport direction, where the front face of said restricted area is defined by the rear edge of the item assigned to the front placement area.

The particular advantage of the invention consists in the fact that, through the detection of the rear edge of the item by means of the detector unit, the contact areas can be defined with a variable length, adapted to the size of the specific item to be detected. As a result, a high degree of automation can be achieved and the error rate in the detection of items can be reduced. In addition, in particular with small sized items, high packing density and improved item flow can be achieved. The restricted area, which is provided between two specific placement areas arranged one behind the other in the transport direction, has a constant length and is dimensioned such that reliable detection of the items by the scanning unit is ensured. By identifying the placement area, dealing with the self-service cash register system is simplified for the customer.

In accordance with a preferred embodiment of the invention, the detector unit has an optical sensor for the contactless detection of the rear edge of the item. The use of an optical sensor advantageously ensures rapid and reliable identification of the rear edge of the item. Mechanical contact with the item is avoided, with the result that the item is protected from damage. For example, the detector unit can have a camera system to detect the item and to identify the rear edge of the item using image processing.

In accordance with a further development of the invention, a plurality of optical sensors for the item placement surface of the belt conveyor is assigned in such a manner that, by means of the detector unit, a light grid is formed spanning the item placement surface, where a detection plane of the light grid is oriented essentially parallel to a transport plane of the belt conveyor. By providing a light grid, the location of the rear edge of the item can not only be established advantageously at one time, but can be determined continuously or at intervals during the entire transport process. In addition, several items can be detected simultaneously with the aid of the light grid.

To create the light grid, the optical sensors have a transmitting and receiving unit in the style of a light barrier. The light grid is advantageously oriented parallel to the transport plane in order to be able to detect items reliably, independently of their location on the belt conveyor and their size, in particular their height.

In accordance with a further development of the invention, the marking unit has a plurality of light sources arranged laterally adjacent the item placement surface of the belt conveyor, and extending in the transport direction. The light surfaces serve to identify the placement areas or the restricted areas optically. Advantageously, placement of the items on the transport unit is particularly easy for the customer if the placement areas and restricted areas are visually highlighted and easy to recognize. By providing the plurality of light sources arranged adjacent each other in the transport direction, the placement areas, for example, can be lit up. For example, the light sources can emit light of different colors to illuminate the placement areas for the customer in a first color (e.g. green) and the restricted areas in a second color (e.g. red). The light sources for the marking unit can be moved in concert with the belt conveyor moving in the transport direction or be assigned fixed in position to the transport unit.

To achieve the object of the invention, the invention in conjunction with the preamble of claim 7 is characterized in that a rear edge of an item, as viewed in the transport direction, is detected by a sensor to determine a rear face of a placement area, as viewed in the transport direction, on the one hand, and a front face of a restricted area of the item placement surface, where two placement areas lying one behind the other as viewed in the transport direction are separated from each other by a restricted area.

The particular advantage of the invention consists of the fact that the placement areas are assigned a variable length adapted to the position and size of the items to be recorded. As a result of the variable length, packing density can be increased and item flow improved. In addition, large or bulky items can be prevented from protruding beyond rigidly prescribed limits for the placement surface.

In accordance with a preferred embodiment of the invention, the restricted area is indicated by the marking unit. Advantageously, the customer receives visual feedback both regarding the limits of the placement areas and the limits of the restricted areas. As a result, the correct placement of the items on the belt conveyor is further simplified. The marking unit identifies the location of the placement areas and the location of the restricted areas; the marking unit assumes a double function with the result that the overall solution can be realized particularly inexpensively, or additional identification of the restricted areas is possible without appreciable additional expense.

In accordance with a further development of the invention, the location of the placement areas or restricted areas is made recognizable continuously during transportation to generate a dynamic placement or restricted area display. For example, a dynamic visualization in the manner of a light conveyor belt is advantageously made possible. For this purpose, a plurality of light sources are arranged one behind the other, preferably to the side adjacent the belt conveyor, in such a way that the placement and restricted areas are not indicated statically but "drift" matching the speed of transportation. The dynamic placement and restricted area display simplifies handling and ensures that the placement areas are displayed at all times.

BRIEF DESCRIPTION OF THE DRAWINGS

Additional advantages of the invention become clear from the additional dependent claims.

DETAILED DESCRIPTION OF THE PREFERRED EMBODIMENTS

Figure 1:
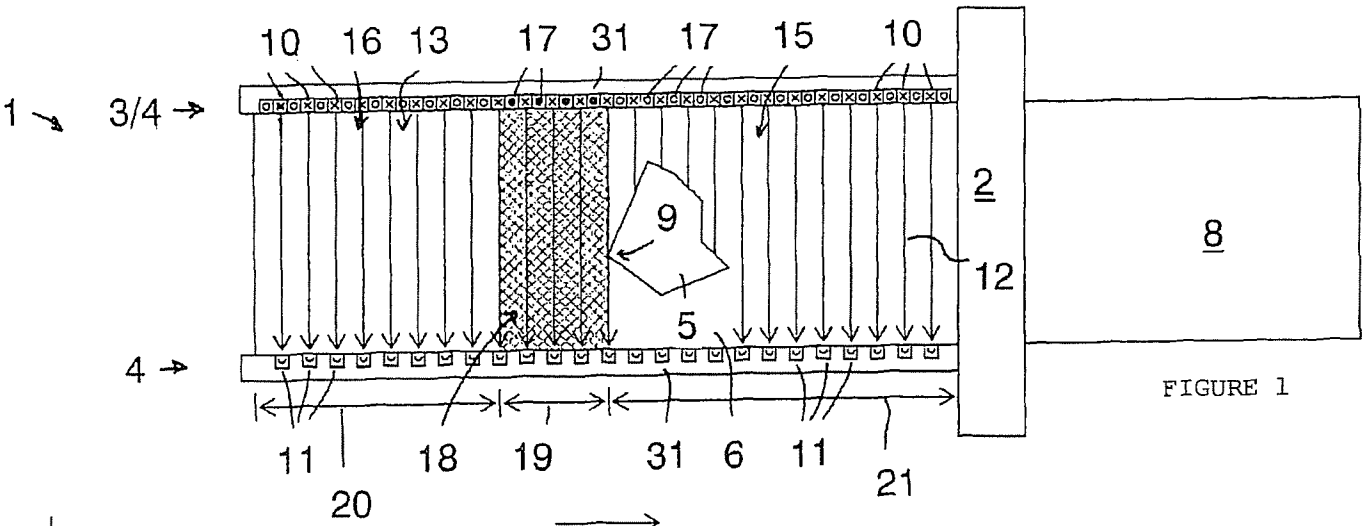
FIG. 1 shows a first embodiment of the transport unit in accordance with the invention in a first operating position.
Figure 2:
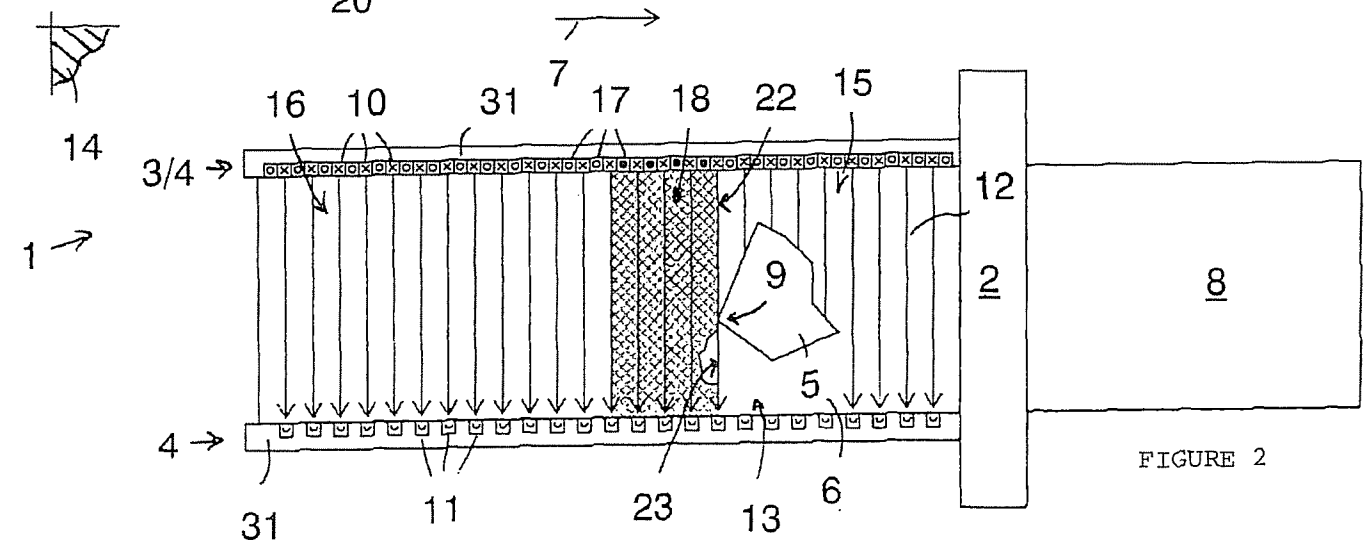
FIG. 2 shows the first embodiment from FIG. 1 in a second operating position.

A self-service cash register system from FIGS. 1 and 2 shown schematically in plan view has as its essential components a transport unit 1, a scanning unit 2, a marking unit 3 and a detector unit 4. Such self-service cash register systems are increasingly used in retail to record the items selected by the customer automatically and to reduce the costs of the payment process.

The scanning unit 2 is constructed, as an example, in the manner of a tunnel scanner. Said scanning unit serves to optically scan the surface of an item 5 to be recorded without contact and in particular to record a marking serving to identify the item 5. For this purpose, the scanning unit 2 has a plurality of scanning modules mounted on and distributed over a frame extending over the transport unit 1 in the shape of an archway, by means of which the item 5 is scanned. Typically the scanning unit 2 has in addition a further scanning module located below the transport unit 1, by means of which a contact surface of the item 5 that is lying on the transport unit 1 can be scanned optically through a recess in the transport unit 1.

The transport unit 1 has a belt conveyor 6 as an essential component that is preferably configured as an endless belt conveyor and serves to convey the item 5 in a transport direction 7 to the scanning unit 2. Furthermore, the transport unit 1 includes transport means configured, as an example, as a further belt conveyor to transport the item 5 away from the scanning unit 2. The item 5 is taken via the additional belt conveyor to a collection area where the recorded item is ready for removal by the customer.

In order to be recorded by means of said scanning unit 2, said items must be conveyed sequentially to the scanning unit 2. For this purpose, it is necessary for the items to be placed separately and spaced apart on the belt conveyor 6. The detection unit 4 is provided to assist the customer in separating the items. A rear edge of the item 9 is optically detected by means of the detection unit 4. The detection unit 4 has a plurality of transmitting units 10 and optical receiving units 11 that operate in the manner of a light barrier and generate a light grid 12. Each single transmitting unit 10 and receiving unit 11 defines an optical sensor of the detection unit 4. The light grid 12 extends over the belt conveyor 6 perpendicular to the transport direction 7.

The optical transmitting and receiving units 10, 11 are arranged on opposite sides of the belt conveyor 6 at the side adjacent said belt and extend in the transport direction 7 in such manner that the light grid 12 completely spans an item placement area 13 on the belt conveyor 6 defined by the slack side of the belt conveyor 6. A detection plane of the light grid is oriented essentially parallel to a transport plane 14 of the belt conveyor 6.

The marking unit 3 is formed by a plurality of light sources 17 arranged at the side adjacent the item placement surface 13 of the belt conveyor 13, extending in the transport direction 7, and assigned fixed in place to the transport unit 13. The marking unit 3 serves to provide a plurality of placement areas 15, 16 on the item placement surface for placing items 5 in a visually recognizable manner. For example, the light sources 17 of the marking units 3 arranged to the side of the placement areas 15, 16 can be activated for this purpose. It is easy for the customer to recognize at which location the item 5 can be placed on the item placement surface 13 of the belt conveyor 6.

The transmitting and receiving units 10, 11 of the detection unit 4 generating the light grid 12 are, like the light sources for the marking unit 3 of the transport unit 1, arranged fixed in place and adjacent the belt conveyor 6 at the side. Transmitting and receiving units 10, 11 and light sources 17 are preferably arranged integral with a side panel 31 of the transport unit 1 specifically to be protected against mechanical stresses and contamination. The panel 31 can protect additional components, specifically the moving components of the transport unit 1, against access from the outside.

To improve item identification on the one hand and customer guidance on the other, two adjacent placement areas 15, 16 in the transport direction are separated from each other by an restricted area 18. The restricted area 18 has a preferably constant length 19 and is dimensioned such that the items conveyed sequentially to the scanning unit 2 can be recorded reliably.

The light sources 17 arranged laterally adjacent the exclusion area 18 are not active in accordance with the present embodiment so that the customer can easily differentiate between the placement area 15, 16 and the restricted area 18 of the item placement surface 13.

To increase item flow and packing density of the items 5, the placement areas 15, 16 have a variable length 20, 21. To determine the time-variable length 20, 21 of the placement areas 15, 16 based on the transport movement which is dependent on the location of the item 5 on the belt conveyor 6 and the size of the item 5, a control unit, not shown, cooperates with the marking unit 2 and the detection unit 4. The rear edge of the item 9 detected by means of the detection unit 4 defines both the rear face 22, as viewed in the transport direction 7, of the front item placement area 15, as viewed in the transport direction 7, as well as the front face 23 of the restricted area, as viewed in the transport direction 7, separating the front placement area 15 from a rear placement area 16, as viewed in the transport direction. In this way, the front placement area 15 is a guaranteed minimal length 21 with a given location of the item 5 and the restricted area 18 abuts immediately against the placement area 15. The rear edge of the item 9 on the one hand and the rear face 22 of the front placement area 15, or the front face 23 of the restricted/exclusion area 18 on the other, diverging from the principle illustration from FIGS. 1 and 2, can be spaced apart from each other, specifically a distance of 5 cm or less.

As shown, the position and the length 20, 21 of the placement areas 15, 16 change during the transportation of the item 5. To be able to visualize the placement area 15, 16 and the restricted area 18 during the transportation of the item 5 dynamically, the control unit controls the light sources and in this way generates a light belt conveyor for the dynamic placement area and restricted area display.

Figure 3:
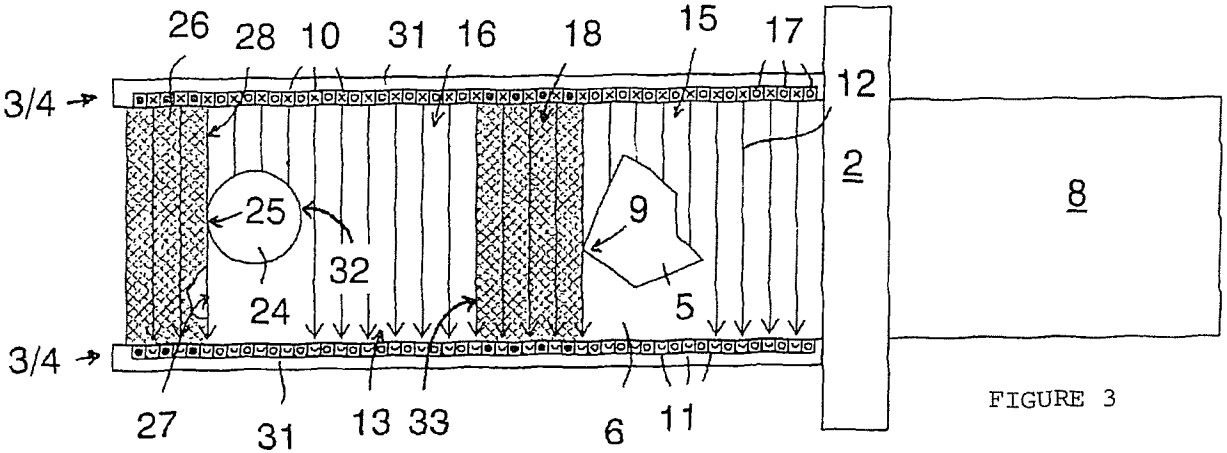
FIG. 3 shows a second embodiment of the transport unit.

By way of example, a second embodiment from FIG. 3 shows the belt conveyor 6 with the first item 5 and second item 24. The second item 24 is placed by the customer at any point on the rear placement area 16. The detection unit 4 identifies a rear edge 25 of the second item 24 in a known way. The rear placement area 16, as viewed in the transport direction 7, is an area restricted by the rear edge 25 of the second item 24. A further restricted area 26 adjoins the rear placement area 16.

Identical components and component functions in the alternative embodiments of the invention are given the same reference numerals.

In accordance with the second embodiment of the invention, the marking unit 3 has light sources 17 on opposite sides of the belt conveyor 6. By providing light sources 17 on both sides of the belt conveyor 6, visualization of the placement areas 15, 16 and the restricted areas 18 is improved. For example, items can be placed from both long sides on the belt conveyor 6.

Naturally, more than two items 5, 24 can be placed simultaneously on the item placement surface 13 of the belt conveyor 6 and conveyed to the scanning unit 2. The packing density of the transport unit 1 is limited by the number of items 5, 24, the length 19 of the restricted areas 18, 26 and the location of the items 5, 24 in the placement areas 15, 16. Maximum packing density would be achieved if the placement areas 15, 16 have a minimal length, that is to say, if a front edge 32 of the second item 24 borders lies immediately/directly on/against a rear face 33 of the front restricted area 18, as viewed in the transport direction 7. The length of the rear placement area 16 is then defined by the length of the second item 24.

Figure 4:
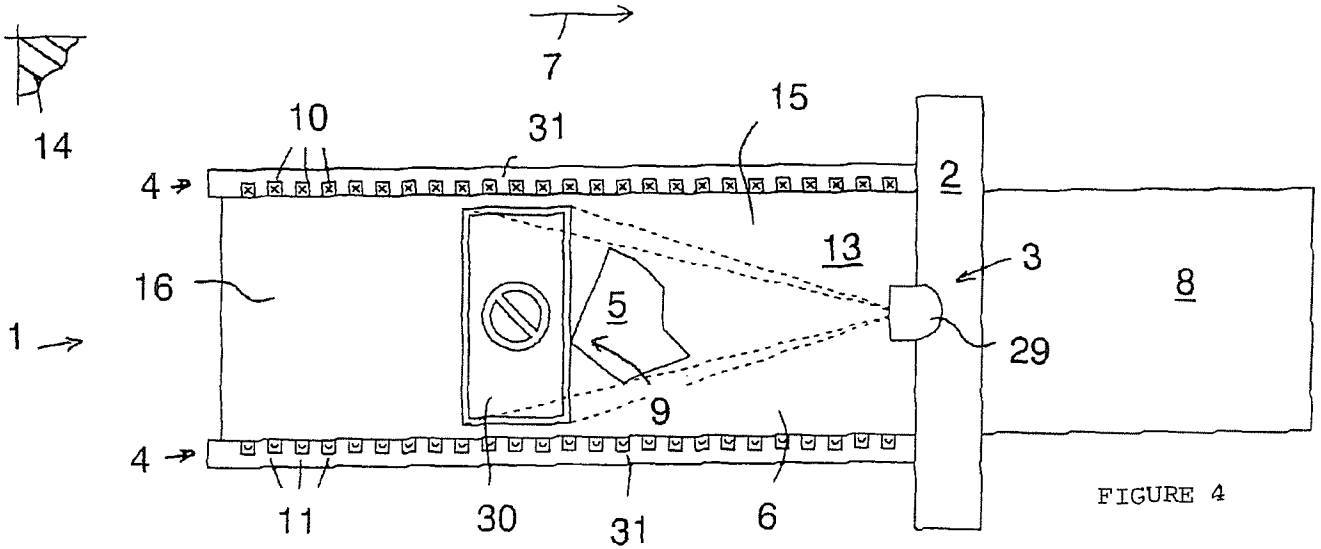
FIG. 4 shows a third embodiment of the transport unit.

In accordance with a third embodiment of the invention from FIG. 4, the marking unit 3 has a projection module 29. The projection module 29, which by way of example is arranged in the area of the scanning unit 2, serves to project a marking 30 identifying the restricted area 18 onto the item placement area 13 of the belt conveyor 6. The customer recognizes from the marking 30 that this area is not intended for the placement of items 5, 24. An illustration of the light grid 12 has been omitted simply for reasons of clarity.

Instead of projecting a marking 30 in the area of the restricted area 18, the next respective placement area (rear placement area 16) can be highlighted by means of the projection module 29.

The detection unit 4 has, by way of example, only a plurality of transmitting and receiving units 10, 11 arranged adjacent each other in the transport direction 7 to construct the light grid 12. As an alternative, each suitable sensor, specifically each suitable optical sensor, can be used for the detection of the rear edge 9, 25 of the item. For example, a camera-assisted detection unit 4 can be provided, where the rear edges 9, 25 of the item are identified by means of image processing.

What is claimed is:

1. A transport unit for conveying items to a scanning unit of a self-service cash register system comprising:

a belt conveyor for transporting the item in a transport direction;

a marking unit assigned to the belt conveyor to simultaneously identify a front placement area and a rear placement area upstream of the scanning unit in the transport direction, and open for the placement of items on an item placement surface of the belt conveyor;

a detection unit assigned to the belt conveyor configured to detect a rear edge of an item on the item placement surface, as viewed in the transport direction; and a control unit configured to cooperate with the marking unit and the detection unit to identify a restricted area of the belt conveyor that is between the front and rear placement areas, the restricted area being off-limits to item placement;

wherein a front face of said restricted area, as viewed in the transport direction, is defined by the rear edge of the item assigned to the front placement area.

2. The transport unit from claim 1, wherein the detection unit has an optical sensor including a transmitting unit and a receiving unit for the contactless recording of the rear edge of the item.

3. The transport unit from claim 1, wherein a plurality of optical sensors, each including a transmitting unit and a receiving unit, are assigned to the item placement surface of the belt conveyor in such a manner that by means of the detection unit a light grid is formed spanning the item placement surface, where a detection plane of the light grid is oriented essentially parallel to a transport plane of the belt conveyor.

4. The transport unit from claim 1, wherein the marking unit has a plurality of light sources arranged laterally adjacent to the item placement surface of the belt conveyor, extending in the transport direction, by means of which the placement areas and/or the restricted areas can be identified.

5. The transport unit from claim 1, wherein the sensors (transmitting unit, receiving unit) of the detection unit and/or the light sources of the marking unit are arranged integral with external paneling assigned to the belt conveyor at the side and extending in the transport direction.

6. The transport unit from claim 1, wherein the marking unit has a projection module for projecting a marking identifying the restricted area onto the item placement surface.

7. A method for conveying items to a scanning unit of a self-service cash register system on a belt conveyor of a transport unit comprising:

identifying on the belt conveyor upstream of the scanning unit in a transport direction a first placement area, a second placement area, and a restricted area;

identifying the restricted area between the first and the second placement areas such that the first placement area is adjacent to an upstream side of the restricted area in the transport direction and the second placement area is adjacent to a downstream side of the restricted area in the transport direction; and identifying the first placement area, the second placement area, and the restricted area on the belt conveyor with a marking unit.

8. The method from claim 7, further comprising using the marking unit to make the restricted area recognizable.

9. The transport unit from claim 1, wherein the location of the placement areas and/or the restricted areas during transportation of the items is made continuously recognizable to generate a dynamic placement and restricted area display.

10. The transport unit from claim 1, wherein the rear edge of the item is optically detected and/or the restricted area and/or the placement area are made visually recognizable.

11. The method of claim 7, further comprising defining a plurality of restricted areas each being identical in size.

12. The method of claim 7, further comprising defining a front face of the restricted area as viewed in a transport direction by a rear edge of a front placement area of the plurality of open placement areas.

13. The method of claim 7, further comprising varying a length of each one of the first and second placement areas with respect to a transport direction based on sizes of items placed within either the first or the second placement areas.

14. The method of claim 7, wherein the first and second placement areas move with the belt conveyor, and are fixed with respect to items placed on the belt conveyor.

15. The method of claim 7, wherein the restricted area moves with the belt conveyor, and is fixed relative to an item placed on the belt conveyor.

16. A method for transporting items along a belt conveyor to a scanning unit, the method comprising:

defining a front placement area of the belt conveyor positioned upstream of the scanning unit in a transport direction based on location of a rear edge of an item placed on the belt conveyor;

defining a restricted area of the belt conveyor based on location of the rear edge of the item placed on the belt conveyor; and defining a rear placement area of the belt conveyor positioned upstream of the scanning unit and adjacent to the restricted area on a side of the restricted area opposite to the front placement area;

wherein the front placement area, the restricted area, and the rear placement area move with the belt conveyor towards the scanning unit and are simultaneously defined on the belt conveyor prior to the item being transported to the scanning unit by the belt conveyor.

17. The method of claim 16, further comprising defining the restricted area such that it moves with the belt conveyor and has a predetermined and constant area independent of a size of the item.

18. The method of claim 17, further comprising making a length of the front placement area measured parallel to a transport direction of the belt conveyor dependent on location of the rear edge of the item placed on the belt conveyor.

19. The method of claim 16, further comprising varying a length of both the front placement area and the rear placement area depending on a length of the item placed thereon.

* * * * *